US009688357B1

(12) United States Patent
Chen

(10) Patent No.: US 9,688,357 B1
(45) Date of Patent: Jun. 27, 2017

(54) FOLDABLE BOAT

(71) Applicant: Chih-Yung Chen, Puli Township, Nantou County (TW)

(72) Inventor: Chih-Yung Chen, Puli Township, Nantou County (TW)

( * ) Notice: Subject to any disclaimer, the term of this patent is extended or adjusted under 35 U.S.C. 154(b) by 0 days.

(21) Appl. No.: 15/092,318

(22) Filed: Apr. 6, 2016

(51) Int. Cl.
*B63B 7/04* (2006.01)
*B63B 39/00* (2006.01)
*B63B 7/00* (2006.01)

(52) U.S. Cl.
CPC ..... *B63B 7/04* (2013.01); *B63B 39/00* (2013.01); *B63B 2007/003* (2013.01); *B63B 2007/006* (2013.01)

(58) Field of Classification Search
CPC ..... B63B 7/00; B63B 2007/003; B63B 2007/006; B63B 7/02; B63B 7/04; B63B 7/06; B63B 7/08; B63B 7/082; B63B 1/14; B63B 2001/209
See application file for complete search history.

(56) References Cited

U.S. PATENT DOCUMENTS 5,477,804 A * 12/1995 Chan ..... B63B 7/04 114/123
7,461,607 B2 * 12/2008 Reilly ..... B63B 7/04 114/61.1
8,656,856 B1 * 2/2014 Morrow ..... B63B 7/04 114/354
9,016,220 B2 * 4/2015 Gariepy ..... B63B 5/24 114/61.15
2012/0006242 A1 * 1/2012 Gracia Gonzalez .... B63B 1/125 114/39.26
2014/0080367 A1 3/2014 Gariepy et al.

FOREIGN PATENT DOCUMENTS

TW 259074 10/1995

* cited by examiner

*Primary Examiner* — Andrew Polay
(74) *Attorney, Agent, or Firm* — LeClairRyan

(57) ABSTRACT

A foldable boat includes a boat hull, left and right wing members, two forward buoyant bodies, and two rearward buoyant bodies. When the foldable boat is in a folded position, flat bodies of the left and right wing members are substantially perpendicular to a bottom wall of the boat hull, and the forward and rearward buoyant bodies can be packed in an accommodation space of the boat hull. When the foldable boat is in an unfolded position, the flat bodies are substantially parallel to the bottom wall, and each of the forward buoyant bodies and a corresponding one the rearward buoyant bodies are fastened to a corresponding one of the left and right wing members so as to provide a buoyant force to the boat hull.

12 Claims, 5 Drawing Sheets

FOLDABLE BOAT

FIELD

The disclosure relates to a boat, more particularly to a foldable boat.

BACKGROUND

A conventional small boat such as a dinghy, a canoe, etc., normally has a specific fixed shape in order to facilitate movement on water. Therefore, it is not convenient to store and transport such small boat. In addition, as the conventional small boat generally has a narrow width, high winds or waves may cause the small boat to capsize or overturn in water.

SUMMARY

Therefore, an object of the disclosure is to provide a novel foldable boat which is convenient for storage and transportation and which is less likely to capsize or overturn in water.

According to the disclosure, a foldable boat includes a boat hull, a left wing member, a right wing member, two forward buoyant bodies, and two rearward buoyant bodies. The boat hull includes a bottom wall, a bow section, a stern section, a port section, and a starboard section. The bottom wall extends in a longitudinal direction to terminate at forward and rearward marginal edges, and further extends in a transverse direction transverse to the longitudinal direction to terminate at left and right marginal edges. The bow section is disposed forwardly of the forward marginal edge. The stern section extends upwardly from the rearward marginal edge. The port section extends upwardly from the left marginal edge to terminate at a left gunwale. The starboard section extends upwardly from the right marginal edge to terminate at a right gunwale, and defines, in cooperation with the stern section, the port section, and the bottom wall, an accommodation space having a predetermined volume. The left wing member includes a left flat body and a left side frame. The left flat body extends along a left lengthwise line and has an outer marginal region and an inner marginal region. The inner marginal region of the left flat body is hinged to the left gunwale so as to permit the left flat body to be turnable about a left hinge axis in the longitudinal direction between a left folded position, where the left flat body is substantially perpendicular to the bottom wall, and a left unfolded position, where the left flat body is substantially parallel to the bottom wall. The left side frame extends from the outer marginal region of the left flat body along a left transverse line relative to the left lengthwise line, and is configured to be disposed beneath the left marginal edge of the bottom wall when the left flat body is turned to the left folded position. The left side frame has a front segment and a rear segment. The right wing member includes a right flat body and right side frame. The right flat body extends along a right lengthwise line and has an outer marginal region and an inner marginal region. The inner marginal region of the right flat body is hinged to the right gunwale so as to permit the right flat body to be turnable about a right hinge axis in the longitudinal direction between a right folded position, where the right flat body is substantially perpendicular to the bottom wall, and a right unfolded position, where the right flat body is substantially parallel to the bottom wall. The right side frame extends from the outer marginal region of the right flat body along a right transverse line relative to the right lengthwise line, and is configured to be disposed beneath the right marginal edge of the bottom wall when the right flat body is turned to the right folded position. The right side frame has a front segment and a rear segment. The two forward buoyant bodies and the two rearward buoyant bodies are of a dimension to be packed in the accommodation space. The forward buoyant bodies are configured to be detachably fastened to the front segments of the left and right side frames, respectively, and the rearward buoyant bodies are configured to be detachably fastened to the rear segments of the left and right side frames, respectively, such that each of the forward buoyant bodies and a corresponding one of the rearward buoyant bodies are arranged in tandem so as to provide a buoyant force to the boat hull when the left flat body and the right flat body are in the left unfolded position and the right unfolded position, respectively.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
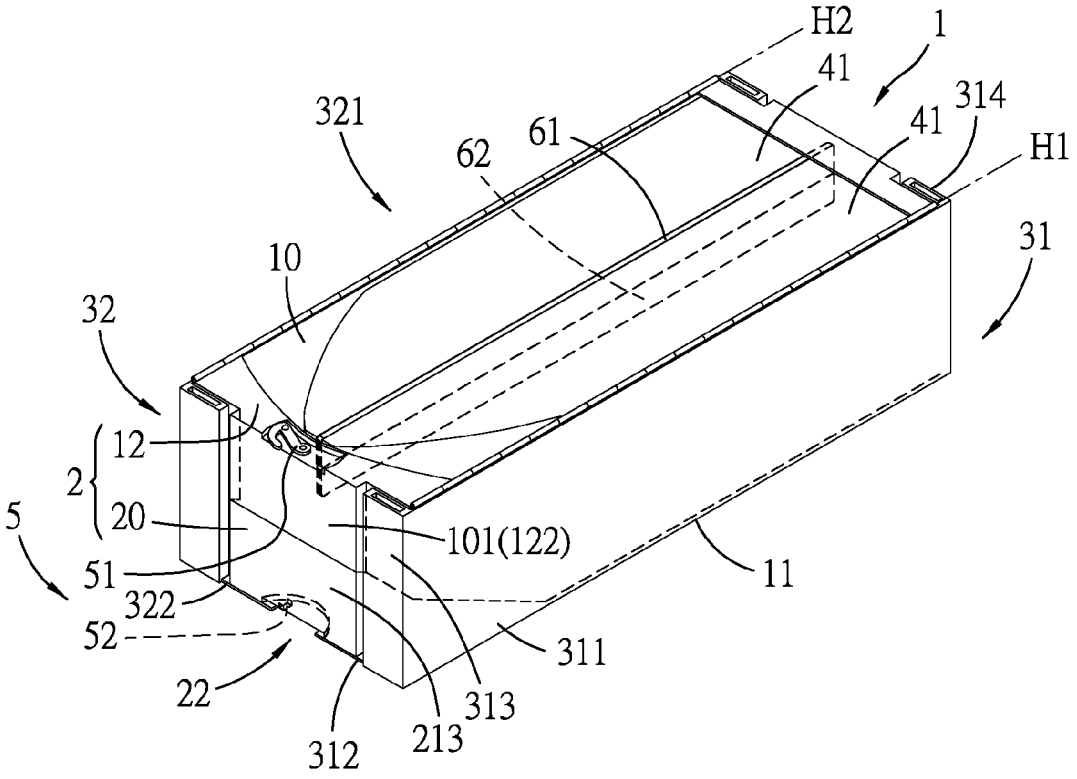
FIG. 1 is a perspective view of a foldable boat in a folded position according to an embodiment of the disclosure.
Figure 2:
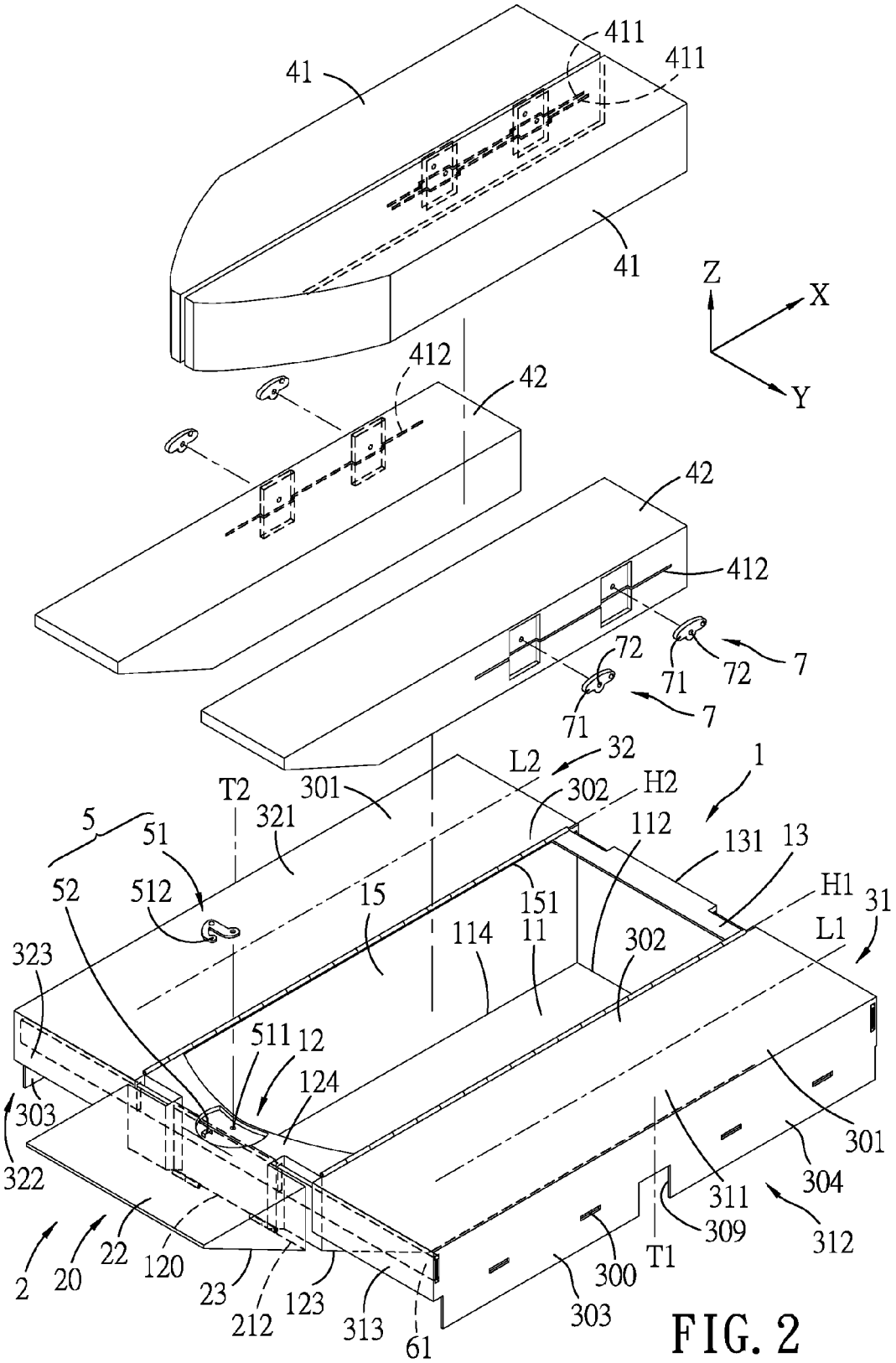
FIG. 2 is a perspective view of the foldable boat, illustrating that a boat hull defines an accommodation space for buoyant bodies to be packed therein.

With reference to FIGS. 1 and 2, a foldable boat according to an embodiment of the disclosure includes a boat hull 1, a left wing member 31, a right wing member 32, two forward buoyant bodies 41, and two rearward buoyant bodies 42.

Figure 3:
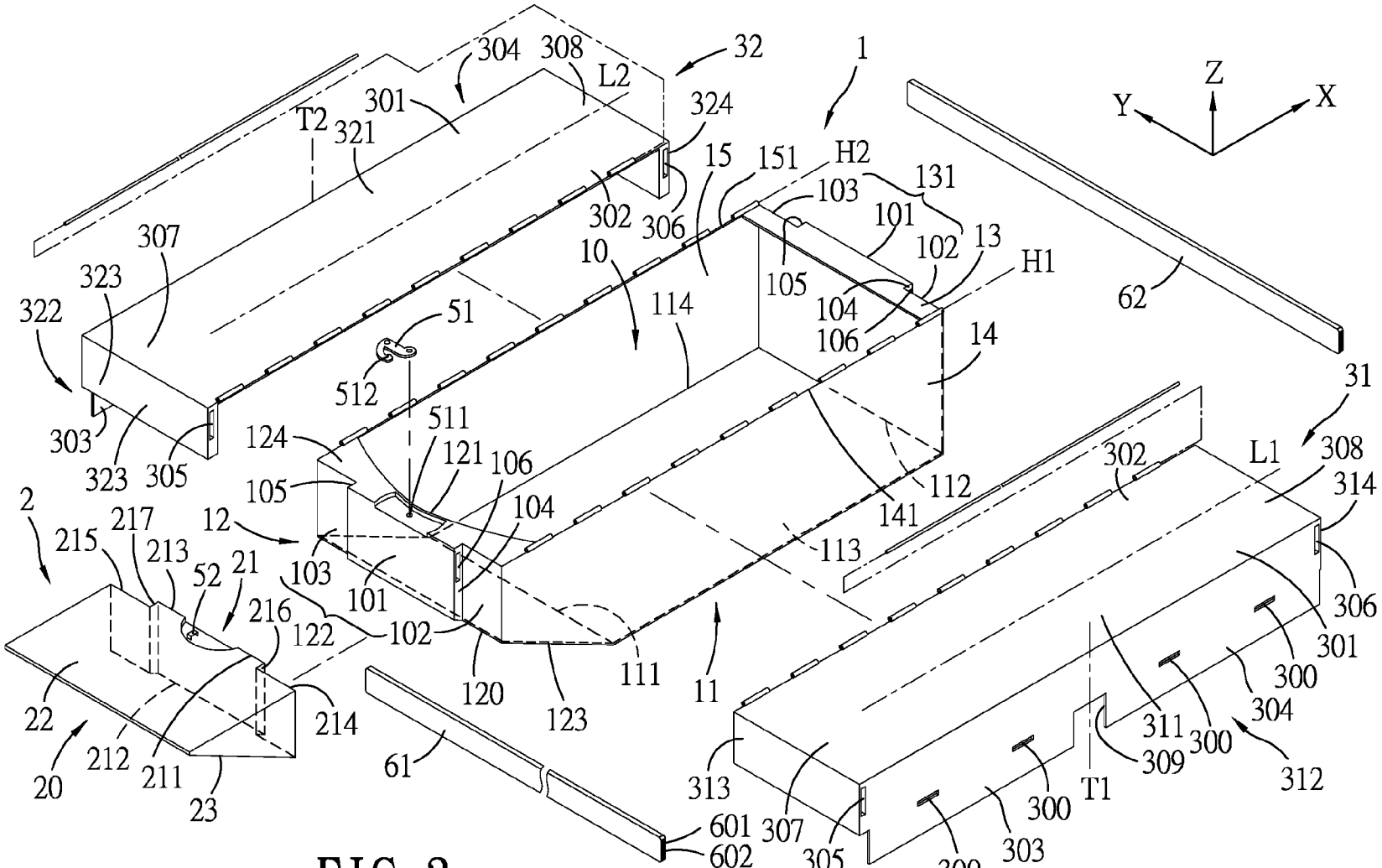
FIG. 3 is an exploded perspective view of the boat hull of the foldable boat.

As shown in FIG. 3, the boat hull 1 includes a bottom wall 11, a bow section 2, a stern section 13, a port section 14, and a starboard section 15.

The bottom wall 11 extends in a longitudinal direction (X) to terminate at forward and rearward marginal edges 111, 112, and further extends in a transverse direction (Y) transverse to the longitudinal direction (X) to terminate at left and right marginal edges 113, 114.

The bow section 2 is disposed forwardly of the forward marginal edge 111. The stern section 13 extends upwardly from the rearward marginal edge 112. The port section 14 extends upwardly from the left marginal edge 113 to terminate at a left gunwale 141. The starboard section 15 extends upwardly from the right marginal edge 114 to terminate at a right gunwale 151. The starboard section 15, the stern section 13, the port section 14, and the bottom wall 11 cooperatively define an accommodation space 10 having a predetermined volume.

Figure 4:
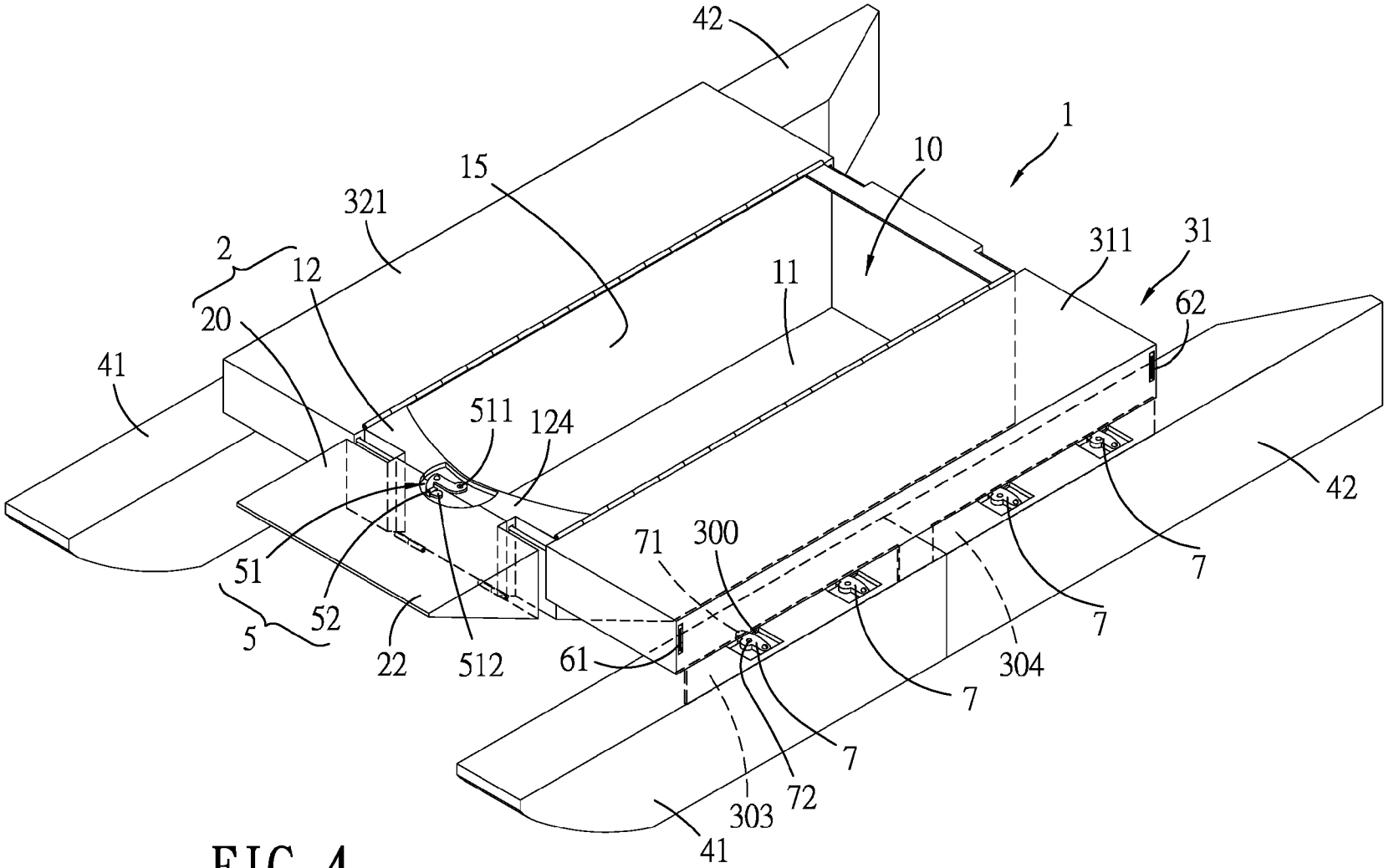
FIG. 4 is a perspective view illustrating the foldable boat in an unfolded position.

The left wing member 31 includes a left flat body 311 and a left side frame 312. The left flat body 311 extends along a left lengthwise line (L1) and has an outer marginal region 301 and an inner marginal region 302. The inner marginal region 302 of the left flat body 311 is hinged to the left gunwale 141 so as to permit the left flat body 311 to be turnable about a left hinge axis (H1) in the longitudinal direction (X) between a left folded position, where the left flat body 311 is substantially perpendicular to the bottom wall 11 (see FIG. 1), and a left unfolded position, where the left flat body 311 is substantially parallel to the bottom wall 11 (FIG. 4).

With reference to FIGS. 2 and 3, the left side frame 312 extends from the outer marginal region 301 of the left flat body 311 along a left transverse line (T1) relative to the left lengthwise line (L1). The left side frame 312 is configured to be disposed beneath the left marginal edge 113 of the bottom wall 11 when the left flat body 311 is turned to the left folded position (FIG. 1). The left side frame 312 has a front segment 303 and a rear segment 304. In this embodiment, when the left flat body 311 is turned to the left folded position, the left side frame 312 is in contact with the bottom wall 11.

The right wing member 32 includes a right flat body 321 and a right side frame 322. The right flat body 321 extends along a right lengthwise line (L2) and has an outer marginal region 301 and an inner marginal region 302. The inner marginal region 302 of the right flat body 321 is hinged to the right gunwale 151 so as to permit the right flat body 321 to be turnable about a right hinge axis (H2) in the longitudinal direction (L) between a right folded position, where the right flat body 321 is substantially perpendicular to the bottom wall 11 (see FIG. 1), and a right unfolded position, where the right flat body 321 is substantially parallel to the bottom wall 11 (see FIG. 4).

With reference to FIGS. 2 and 3, the right side frame 322 extends from the outer marginal region 301 of the right flat body 321 along a right transverse line (T2) relative to the right lengthwise line (L2). The right side frame 322 is configured to be disposed beneath the right marginal edge 114 of the bottom wall 11 when the right flat body 321 is turned to the right folded position (FIG. 1). The right side frame 322 has a front segment 303 and a rear segment 304, which are respectively symmetrical to the front segment 303 and the rear segment 304 of the left side frame 312 in position. In this embodiment, when the right flat body 321 is turned to the right folded position, the right side frame 322 is in contact with the bottom wall 11.

The two forward buoyant bodies 41 and the two rearward buoyant bodies 42 are of a dimension to be packed in the accommodation space 10. The forward buoyant bodies 41 are configured to be detachably fastened to the front segments 303 of the left and right side frames 312, 322, respectively. The rearward buoyant bodies 42 are configured to be detachably fastened to the rear segments 304 of the left and right side frames 312, 322, respectively. When the left flat body 311 and the right flat body 321 are in the left unfolded position and the right unfolded position, respectively, and when the forward buoyant bodies 41 and the rearward buoyant bodies 42 are fastened to the left and right side frames 312, 322, each of the forward buoyant bodies 41 and a corresponding one of the rearward buoyant bodies 42 are arranged in tandem so as to provide a buoyant force to the boat hull 1.

The bow section 2 includes a mounting wall 12 and a bow head 20. As best shown in FIG. 3, the mounting wall 12 extends upwardly from the forward marginal edge 111 of the bottom wall 11 and is disposed between the port section 14 and the starboard section 15. The mounting wall 12 has inner and outer surfaces 121, 122 opposite to each other in the longitudinal direction (X). The inner surface 121 of the mounting wall 12 borders the accommodation space 10. The bow head 20 is detachably attached to the outer surface 122 of the mounting wall 12.

In this embodiment, each of the forward buoyant bodies 41 and the rearward buoyant bodies 42 has a length slightly smaller than a length defined between the mounting wall 12 and the stern section 13.

In this embodiment, the outer surface 122 of the mounting wall 12 has a lower marginal edge 120, and the mounting wall 12 further has an inclined surface 123 extending forwardly and upwardly from the forward marginal edge 111 of the bottom wall 11 to the lower marginal edge 120. The bow head 20 includes an attachment surface 21, a first surface 22, and a second surface 23.

The attachment surface 21 is configured to be detachably attached to the outer surface 122 of the mounting wall 12, and has first and second marginal edges 211, 212 opposite to each other in an upright direction (Z) transverse to both the longitudinal direction (X) and the transverse direction (Y) (see FIG. 3). The second marginal edge 212 is hinged to the lower marginal edge 120 of the outer surface 122 of the mounting wall 12 so as to permit the bow head 20 to be turnable between a use position, where the bow head 20 is disposed forwardly of the mounting wall 12 (see FIG. 2), and a stored position, where the bow head 20 is disposed downwardly of the mounting wall 12 (see FIG. 1).

As best shown in FIG. 3, the first and second surfaces 22, 23 of the bow head 20 extend respectively from the first and second marginal edges 211, 212 and converge toward each other to form an included angle. The first surface 22 is configured to confront the left and right side frames 312, 322 when the bow head 20 is in the stored position (FIG. 1), and when the left flat body 311 and the right flat body 321 are respectively in the left and right folded positions. The second surface 23 is configured to mate with the inclined surface 123 such that when the bow head 20 is in the stored position, the first surface 22 is flush with the bottom wall 11. In addition, when the bow head 20 in the use position, the second surface 23 and the inclined surface 123 cooperatively form an inclined bottom area for directing the flow of water during steering of the foldable boat.

Moreover, the mounting wall 12 further has a top surface 124, and the foldable boat further includes a fastening unit 5 which includes a hook member 51 and an eye member 52. The eye member 52 is disposed on one of the top surface 124 of the mounting wall 12 and the first surface 22 of the bow head 20, and the hook member 51 is disposed on the other of the top surface 124 of the mounting wall 12 and the first surface 22 of the bow head 20. The hook member 51 is configured to be removably engaged in the eye member 52 so as to permit the bow head 20 to be secured to the mounting wall 12 when the bow head 20 is in the use position.

In this embodiment, as shown in FIG. 3, the eye member 52 is a U-shaped metal strip and is disposed on the first surface 22 of the bow head 20. The hook member 51 is pivotally mounted on the top surface 124 of the mounting wall 12 about a pivot axis 511, and has a hook end 512. When the hook member 51 turns counterclockwise about the pivot axis 511, the hook end 512 engages the eye member 52 to thereby keep the bow head 20 in the use position. When the hook member 51 turns clockwise about the pivot axis 511, the hook end 512 disengages from the eye member 52. At this point, the bow head 20 can be displaced to the stored position.

As best shown in FIG. 3, the stern section 13 has an outer surface 131. Each of the outer surfaces 131, 122 of the stern section 13 and the mounting wall 12 has an elevated flat region 101, a left flank region 102, a right flank region 103, and an elongated slot 106. The left flank region 102 and the elevated flat region 101 cooperatively define a first left shoulder 104 therebetween. The right flank region 103 and the elevated flat region 101 cooperatively define a first right shoulder 105 therebetween. The elongated slot 106 is disposed in the first left shoulder 104 and extends in the transverse direction (Y) through the first right shoulder 105.

Moreover, each of the left and right side frames 312, 322 has a front hole 305 and a rear hole 306. The front and rear holes 305, 306 are configured such that when the left and right flat bodies 311, 321 are respectively in the left and right unfolded positions, the front hole 305 of each of the left and right side frames 312, 322 is in alignment with the elongated slot 106 of the mounting wall 12, and the rear hole 306 of each of the left and right side frames 312, 322 is in alignment with the elongated slot 106 of the stern section 13. The foldable boat further includes a front latch bar 61 and a rear latch bar 62. The front and rear latch bars 61, 62 are configured such that when the left and right flat bodies 311, 312 are respectively in the left and right unfolded positions, the front latch bar 61 is permitted to extend through the elongated slot 106 of the mounting wall 12 and the front holes 305 of the left and right side frames 312, 322, and the rear latch bar 62 is permitted to extend through the elongated slot 106 of the stern section 13 and the rear holes 306 of the left and right side frames 312, 322 to thereby keep the left and right flat bodies 311, 321 respectively in the left and right unfolded positions. Each of the front and rear latch bars 61, 62 has a length substantially the same as the length of each of the forward buoyant bodies 41 and the rearward buoyant bodies 42.

In this embodiment, each of the front and rear latch bars 61, 62 has an elongated shell body 601 and a core body 602. The elongated shell body 601 covers the core body 602 and is made of a metal material for providing rigidity to a corresponding one of the front and rear latch bars 61, 62. The core body 602 is made of a buoyant material for giving the corresponding one of the front and rear latch bars 61, 62 a buoyant force. Therefore, even if the front and rear latch bars 61, 62 accidentally fall into water, they can be prevented from sinking to the bottom of the water due to their buoyant forces.

Furthermore, the attachment surface 21 of the bow head 20 has a protruded flat region 213, a left side region 214, and a right side region 215. The protruded flat region 213 is configured such that when the bow head 20 is in the use position, the protruded flat region 213 is attached to the elevated flat region 101 of the outer surface 122 of the mounting wall 12 (see FIGS. 2 and 3), and such that when the bow head 20 is in the stored position, the protruded flat region 213 is juxtaposed with the elevated flat region 101 of the outer surface 122 of the mounting wall 12 (see FIG. 1). The left side region 214 and the protruded flat region 213 cooperatively define a second left shoulder 216 therebetween, as best shown in FIG. 3. The right side region 215 and the protruded flat region 213 cooperatively define a second right shoulder 217 therebetween.

Figure 5:
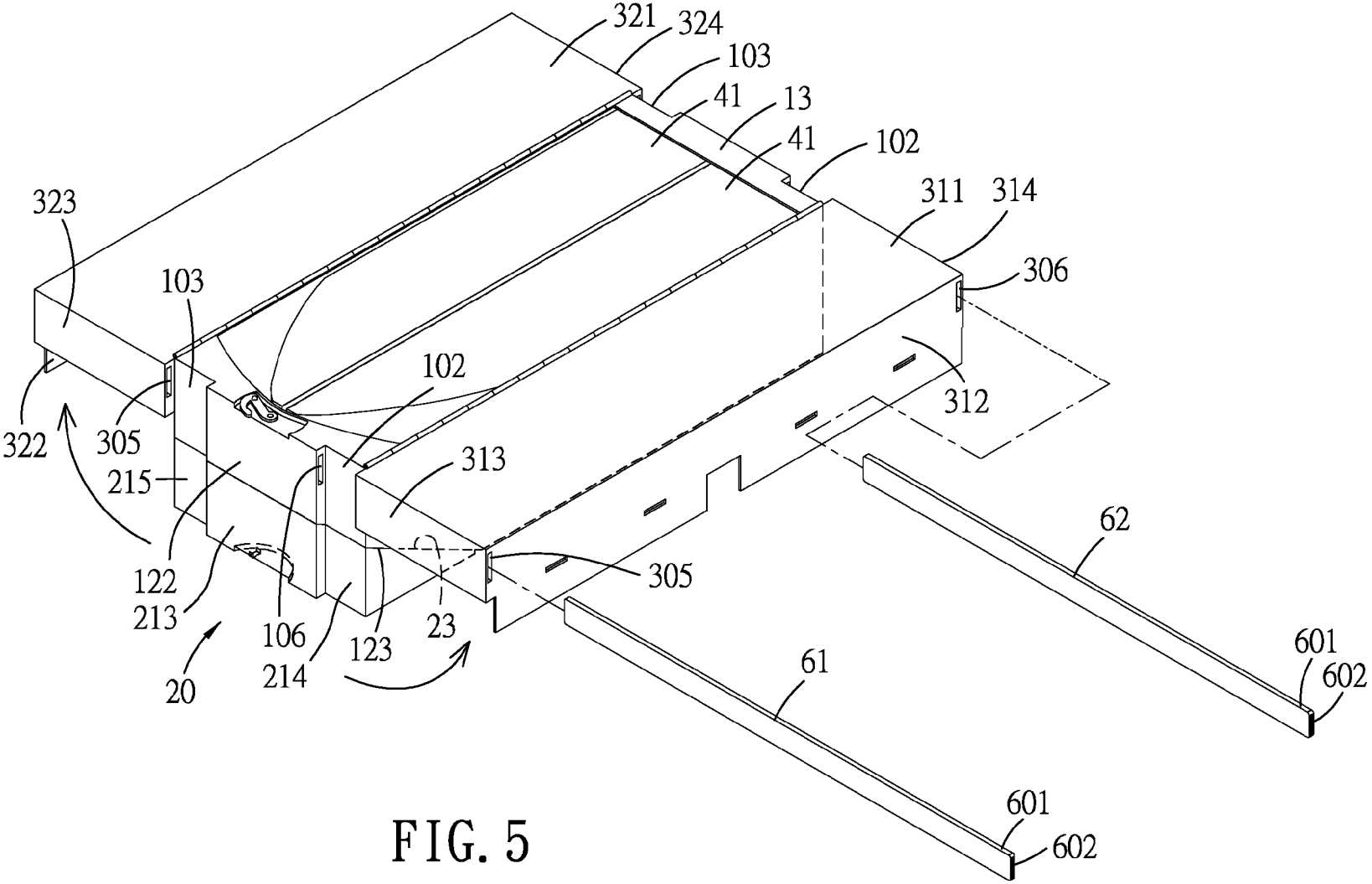
FIG. 5 is a perspective view illustrating a front latch bar and a rear latch bar used to keep the foldable boat in the unfolded position.

As shown in FIGS. 1, 3 and 5, each of the left and right flat bodies 311, 321 has a front end 307 and a rear end 308 opposite to the front end 307. The left wing member 31 further includes a front faceplate 313 and a rear faceplate 314 which respectively extend substantially vertically from the front and rear ends 307, 308 of the left flat body 311, and which are configured such that when the left flat body 311 is in the left folded position (FIG. 1) and when the bow head 20 is in the stored position (FIGS. 1 and 5), the front faceplate 313 of the left wing member 31 shields both the left flank region 102 of the mounting wall 12 and the left side region 214 of the bow head 20, and the rear faceplate 314 of the left wing member 31 shields the left flank region 102 of the stern section 13. In this embodiment, the front hole 305 of the left side frame 312 extends through both the left side frame 312 and the front faceplate 313, and the rear hole 306 of the left side frame 312 extends through both the left side frame 312 and the rear faceplate 314.

Similarly, the right wing member 32 further includes a front faceplate 323 and a rear faceplate 324 which respectively extend substantially vertically from the front and rear ends 307, 308 of the right flat body 321, and which are configured such that when the right flat body 321 is in the right folded position (FIG. 1) and when the bow head 20 is in the stored position (FIGS. 1 and 5), the front faceplate 323 of the right wing member shields both the right flank region 103 of the mounting wall 12 and the right side region 215 of the bow head 20, and the rear faceplate 324 of the right wing member 32 shields the right flank region 103 of the stern section 13. In this embodiment, the front hole 305 of the right side frame 322 extends through both the right side frame 322 and the front faceplate 323, and the rear hole 306 of the right side frame 322 extends through both the right side frame 322 and the rear faceplate 324.

As shown in FIG. 2, each of the forward buoyant bodies has a first slit 411 configured to permit a corresponding one of the front segments 303 of the left and right side frames 312, 322 to be removably inserted thereinto, and each of the rearward buoyant bodies 42 has a second slit 412 configured to permit a corresponding one of the rear segments 304 of the left and right side frames 312, 322 to be removably inserted thereinto.

The front and rear segments 303, 304 of each of the left and right side frames 312, 322 are spaced apart from each other by a gap 309 (see FIG. 2) which is configured to permit each of the forward buoyant bodies 41 to be connected with the corresponding one of the rearward buoyant bodies 42 in an end-to-end relationship (see FIG. 4).

Each of the front and rear segments 303, 304 of the left and right side frames 312, 322 has an engaging hole 300 (see FIG. 2), and the foldable boat further includes eight latch members 7 each having a latch portion 71 and a pivot portion 72. The pivot portion 72 is pivotally mounted to a corresponding one of the forward and rearward buoyant bodies 41, 42 such that each of the latch members 7 is displaceable between a latched position, where the latch portion 71 is engaged in the engaging hole 300 of a corresponding one of the front and rear segments 303, 304 of the left and right side frames 312, 322 (FIG. 4), and a released position. Although eight latch members 7 are exemplified in this embodiment, the number of the latch members 7 should not be limited thereto. Each of the forward and rearward buoyant bodies 41, 42 is fastened to the corresponding one of the front and rear segments 303, 304 of the left and right side frames 312, 322 by one or more of the latch members 7 in the latched position. With the provision of the latch members 7, undesirable detachment of the forward and rearward buoyant bodies 41, 42 from the left and right side frames 312, 322 can be prevented.

As shown in FIG. 1, when the left and right flat bodies 311, 321 are respectively in the left and right folded positions, and the bow head 20 is in the stored position, the forward buoyant bodies 41, the rearward buoyant bodies 42 (disposed downwardly of the forward buoyant bodies 41), the front latch bar 61, and the rear latch bar 62 can all be stored in the accommodation space 10. Thus, the foldable boat can be transformed into a compact form for storage and transportation.

In addition, when the left and right flat bodies 311, 321 are respectively in the left and right unfolded positions (FIG. 4), the foldable boat including the boat hull 1 and the left and right wing members 31, 32 has a relatively wide width and can be supported steadily on water by virtue of the buoyant forces of the forward buoyant bodies 41 and the rearward buoyant bodies 42. Therefore, the foldable boat is less likely to capsize or overturn in water.

Besides, the foldable boat may further include a drive motor (not shown) mounted on the stern section 13 for driving the foldable boat to move forwardly.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A foldable boat comprising:

a boat hull including a bottom wall extending in a longitudinal direction to terminate at forward and rearward marginal edges, and further extending in a transverse direction transverse to the longitudinal direction to terminate at left and right marginal edges, a bow section disposed forwardly of said forward marginal edge, a stern section extending upwardly from said rearward marginal edge, a port section extending upwardly from said left marginal edge to terminate at a left gunwale, and a starboard section which extends upwardly from said right marginal edge to terminate at a right gunwale, and which, in cooperation with said stern section, said port section, and said bottom wall, defines an accommodation space having a predetermined volume;

a left wing member including a left flat body which extends along a left lengthwise line and which has an outer marginal region and an inner marginal region, said inner marginal region of said left flat body being hinged to said left gunwale so as to permit said left flat body to be turnable about a left hinge axis in the longitudinal direction between a left folded position, where said left flat body is substantially perpendicular to said bottom wall, and a left unfolded position, where said left flat body is substantially parallel to said bottom wall, and a left side frame which extends from said outer marginal region of said left flat body along a left transverse line relative to the left lengthwise line, and which is configured to be disposed beneath said left marginal edge of said bottom wall when said left flat body is turned to the left folded position, said left side frame having a front segment and a rear segment;

a right wing member including a right flat body which extends along a right lengthwise line and which has an outer marginal region and an inner marginal region, said inner marginal region of said right flat body being hinged to said right gunwale so as to permit said right flat body to be turnable about a right hinge axis in the longitudinal direction between a right folded position, where said right flat body is substantially perpendicular to said bottom wall, and a right unfolded position, where said right flat body is substantially parallel to said bottom wall, and a right side frame which extends from said outer marginal region of said right flat body along a right transverse line relative to the right lengthwise line, and which is configured to be disposed beneath said right marginal edge of said bottom wall when said right flat body is turned to the right folded position, said right side frame having a front segment and a rear segment; and two forward buoyant bodies positioned beneath said left flat body and said right flat body and two rearward buoyant bodies positioned beneath said left flat body and said right flat body, which are of a dimension to be packed in said accommodation space, said forward buoyant bodies being detachably fastened to said front segments of said left and right side frames, respectively, said rearward buoyant bodies being detachably fastened to said rear segments of said left and right side frames, respectively, such that each of said forward buoyant bodies and a corresponding one of said rearward buoyant bodies are arranged in tandem so as to provide a buoyant force to said boat hull when said left flat body and said right flat body are in the left unfolded position and the right unfolded position, respectively.

2. The foldable boat according to claim 1, wherein said bow section includes a mounting wall extending upwardly from said forward marginal edge of said bottom wall and disposed between said port section and said starboard section, said mounting wall having inner and outer surfaces opposite to each other in the longitudinal direction, said inner surface of said mounting wall bordering said accommodation space, and a bow head detachably attached to said outer surface of said mounting wall.

3. The foldable boat according to claim 2, wherein said outer surface of said mounting wall has a lower marginal edge, and said mounting wall further has an inclined surface extending forwardly and upwardly from said forward marginal edge of said bottom wall to said lower marginal edge, said bow head including an attachment surface configured to be detachably attached to said outer surface of said mounting wall, and having first and second marginal edges opposite to each other in an upright direction transverse to both the longitudinal direction and the transverse direction, said second marginal edge being hinged to said lower marginal edge of said outer surface of said mounting wall so as to permit said bow head to be turnable between a use position, where said bow head is disposed forwardly of said mounting wall, and a stored position, where said bow head is disposed downwardly of said mounting wall, and first and second surfaces extending respectively from said first and second marginal edges and converging toward each other to form an included angle, said first surface being configured to confront said left and right side frames when said bow head is in the stored position, and when said left flat body and said right flat body are respectively in the left and right folded positions, said second surface being configured to mate with said inclined surface such that when said bow head is in the stored position, said first surface is flush with said bottom wall.

4. The foldable boat according to claim 3, wherein said mounting wall further has a top surface, said foldable boat further comprising a fastening unit which includes an eye member disposed on one of said top surface of said mounting wall and said first surface of said bow head, and a hook member which is disposed on the other of said top surface of said mounting wall and said first surface of said bow head, and which is configured to be removably engaged in said eye member so as to permit said bow head to be secured to said mounting wall when said bow head is in the use position.

5. The foldable boat according to claim 4, wherein said stern section has an outer surface, and each of said outer surfaces of said stern section and said mounting wall has an elevated flat region, a left flank region which defines, in cooperation with said elevated flat region, a first left shoulder therebetween, a right flank region which defines, in cooperation with said elevated flat region, a first right shoulder therebetween, and an elongated slot disposed in said first left shoulder and extending in the transverse direction through said first right shoulder; and wherein each of said left and right side frames has a front hole and a rear hole, said front and rear holes being configured such that when said left and right flat bodies are respectively in the left and right unfolded positions, said front hole of each of said left and right side frames is in alignment with said elongated slot of said mounting wall, and said rear hole of each of said left and right side frames is in alignment with said elongated slot of said stern section, said foldable boat further comprising a front latch bar and a rear latch bar, said front and rear latch bars being configured such that when said left and right flat bodies are respectively in the left and right unfolded positions, said front latch bar is permitted to extend through said elongated slot of said mounting wall and said front holes of said left and right side frames, and said rear latch bar is permitted to extend through said elongated slot of said stern section and said rear holes of said left and right side frames to thereby keep said left and right flat bodies respectively in the left and right unfolded positions.

6. The foldable boat according to claim 5, wherein each of said front and rear latch bars has a length substantially the same as a length of each of said forward buoyant bodies and said rearward buoyant bodies.

7. The foldable boat according to claim 5, wherein each of said front and rear latch bars has an elongated shell body made of metal, and a core body made of a buoyant material, said elongated shell body covering the core body.

8. The foldable boat according to claim 5, wherein said attachment surface of said bow head has a protruded flat region which is configured such that when said bow head is in the use position, said protruded flat region is attached to said elevated flat region of said outer surface of said mounting wall, and such that when said bow head is in the stored position, said protruded flat region is juxtaposed with said elevated flat region of said outer surface of said mounting wall, a left side region which defines, in cooperation with said protruded flat region, a second left shoulder therebetween, and a right side region which defines, in cooperation with said protruded flat region, a second right shoulder therebetween.

9. The foldable boat according to claim 8, wherein each of said left and right flat bodies has a front end and a rear end opposite to said front end;

wherein said left wing member further includes a front faceplate and a rear faceplate which respectively extend substantially vertically from said front and rear ends of said left flat body, and which are configured such that when said left flat body is in the left folded position and when said bow head is in the stored position, said front faceplate of said left wing member shields both said left flank region of said mounting wall and said left side region of said bow head, and said rear faceplate of said left wing member shields said left flank region of said stern section; and wherein said right wing member further includes a front faceplate and a rear faceplate which respectively extend substantially vertically from said front and rear ends of said right flat body, and which are configured such that when said right flat body is in the right folded position and when said bow head is in the stored position, said front faceplate of said right wing member shields both said right flank region of said mounting wall and said right side region of said bow head, and said rear faceplate of said right wing member shields said right flank region of said stern section.

10. The foldable boat according to claim 1, wherein each of said forward buoyant bodies has a first slit configured to permit a corresponding one of said front segments of said left and right side frames to be removably inserted thereinto, and each of said rearward buoyant bodies has a second slit configured to permit a corresponding one of said rear segments of said left and right side frames to be removably inserted thereinto.

11. The foldable boat according to claim 10, wherein said front and rear segments of each of said left and right side frames are spaced apart from each other by a gap configured to permit each of said forward buoyant bodies to be connected with the corresponding one of said rearward buoyant bodies in an end-to-end relationship.

12. The foldable boat according to claim 11, wherein each of said front and rear segments of said left and right side frames has an engaging hole, and said foldable boat further comprises four latch members each having a latch portion and a pivot portion, said pivot portion being pivotally mounted to a corresponding one of said forward and rearward buoyant bodies such that each of said latch members is displaceable between a latched position, where said latch portion is engaged in said engaging hole of a corresponding one of said front and rear segments of said left and right side frames, and a released position.

* * * * *